United States Patent [19]

Hansel

[11] Patent Number: 5,041,026

[45] Date of Patent: Aug. 20, 1991

[54] SWITCH HOUSING CLAMPING SCREW

[75] Inventor: Norbert Hansel, Daisendorf, Fed. Rep. of Germany

[73] Assignee: Eaton Corporation, Cleveland, Ohio

[21] Appl. No.: 452,919

[22] Filed: Dec. 18, 1989

[30] Foreign Application Priority Data

Dec. 23, 1988 [GB] United Kingdom ..... 8830193

[51] Int. Cl.[5] ..... H01R 9/24

[52] U.S. Cl. ..... 439/709; 439/736; 439/813; 411/302; 411/324

[58] Field of Search ..... 439/709, 712, 718, 801, 439/813, 733, 744, 737, 736, 871, 869, 595, 810; 403/320; 411/301-303, 324

[56] References Cited

U.S. PATENT DOCUMENTS

| | | | |
|---|---|---|---|
| 3,585,332 | 6/1971 | Dries | 200/166 |
| 4,669,806 | 6/1987 | Fuchs | 439/712 |
| 4,921,455 | 5/1990 | Marie et al. | 439/709 |

*Primary Examiner*—Gary F. Paumen

*Attorney, Agent, or Firm*—L. G. Vande Zande

[57] ABSTRACT

A ship-open pressure type wiring terminal for electrical apparatus wherein a threaded hole in the terminal is disposed immediately adjacent and aligned with a clearance opening in a plastic housing part overlying the terminal. One or more thin plastic webs integral with the housing part project transversely into the clearance opening and are deflected into the threaded hole upon insertion of a screw through the clearance opening, the web or webs being compressed between associated threaded walls of the screw and terminal hole to provide frictional resistance to rotation of the screw.

7 Claims, 1 Drawing Sheet

SWITCH HOUSING CLAMPING SCREW

BACKGROUND OF THE INVENTION

This invention relates to a switch, e.g. a power tool speed control switch having a housing and a terminal block and when arranged with a terminal clamping screw, which switch may possibly have to be transported from a supplier to the location of a customer where the screw is to be tightened in order to clamp a wire or other conductor terminal.

The switch and screw should preferably not be shipped separately, otherwise time is spent at the terminating location in finding and fitting the screw into the threaded hole.

Also the switch should not be shipped with the screw in its fully screwed in (and tightened down to the bottom) position, because it then has to be loosened and somewhat withdrawn at the terminating or customer location, in order to allow the conductor terminal to be inserted to its clamping position. Loosening, and partially withdrawing by the correct amount at the user location after shipping likewise takes substantial time and resources, e.g. for each power tool manufactured.

If, in an attempt to avoid such time losses, the switch is shipped with the screw initially partially screwed in, it will tend to loosen and fall out or even be lost.

It has been proposed in U.S. Pat. No. 3,585,332, believed to be the state of the art, to embed a plastics pellet, as a separate initial operation, in an external thread, to hold any position in the mating thread. This discloses also withdrawing a bolt one half turn from a fully home position. Although this reference deals with electrical terminals, it never considered shipping a clamping screw stably installed in a pre-clamping position.

It has also been disclosed, in U.S. Pat. No. 4,669,806, to use retaining projections in order to hold a clamping bolt against unwanted rotations, but not by engaging either thread. Also, because there is a clamp bracket which is installed before shipping and abutted, there is no requirement to ship a clamping screw in a stable ready-to-clamp position, which position would be identifiable only by the counted number of turns of relative displacement of the threaded members.

SUMMARY OF THE INVENTION

Accordingly, the invention provides a switch for a portable tool, comprising a housing which has an aperture (3) for arranging over a screw hole (4) in a terminal block (5), one or more lips (7) or part-annular inward projections of distortable e.g. plastic material from the periphery of the aperture. The projections are preferably thinned down from the material of the cover by provision of a tapered section (12) of the aperture.

The invention also provides such a switch for a portable tool, wherein a screw (1) has been partially screwed into a threaded hole (4) in a terminal block underlying said aperture, thereby distorting said lip or inward projection (7) and to a certain degree binding the screw in the threaded hole at an intermediate position.

The switch may be shipped in this condition without the screw moving.

The invention preferably features the screw partially screwed into a position whereat its threaded shank end (9) has stopped just short of the nearest point (10) of a transverse orifice (6) suitable for insertion of a terminal conductor such as wire, to be clamped.

The invention alternatively proposes a switch comprising a housing, an apertured lid or cover, a terminal block in the housing under the lid or cover and having a threaded hole aligned with the aperture in the lid or cover, and a transverse hole in the terminal block communicating with the threaded hole, characterized in that the cover has integral therewith a distortable lip (7) projecting inwards from the periphery of the aperture (3). The invention may comprise a method of transporting the switch comprising screwing a screw into the threaded hole, thereby distorting the lip into the threads of the terminal block, until the shank just ends short of entering the transverse hole. The method may alternatively comprise screwing the screw right in, then withdrawing it a predictable amount to the same position.

BRIEF DESCRIPTION OF THE DRAWINGS

The inventive details will appear more clearly from the following specific description of an embodiment, given in conjunction with the drawing, in which.

DETAILED DESCRIPTION OF THE PREFERRED EMBODIMENT

Figure 1:
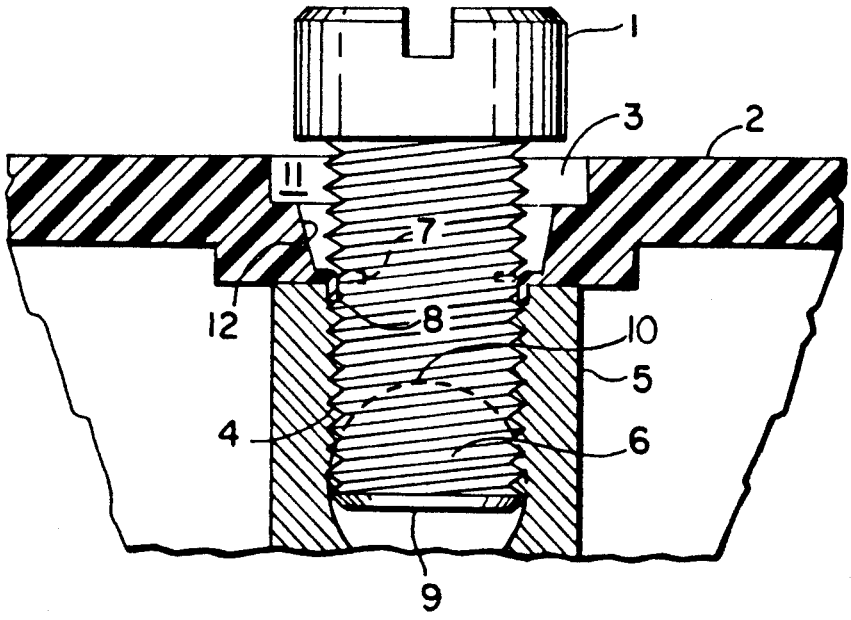
FIG. 1 shows a side section of the switch cover and terminal block with a screw screwed fully in (i.e. excessively by the inventive teaching)

Referring to FIG. 1, which shows a clamping screw 1 fully screwed down in a manner not following the teaching of the invention (namely partially screwing home for shipping), a switch housing or cover 2 has a clearance hole 3 for screw 1 which is fully engaged as with threads 4 in a terminal block 5.

The clamping screw is so far down that it more than half obscures a transverse hole 6 which may, as shown, have the same diameter as the threaded hole in the terminal block.

Hole 6 is for terminal conductors such as wire, not shown, and the hole is accessible from outside the switch in some manner to feed in wire or other longitudinal conductor means. When the screw is fully home as shown, wire cannot be inserted and the screw must be withdrawn several turns, which undesirably takes time and resources in the typical production environment of a portable tool factory, or like consumer of the switch (for speed control or the like).

Accordingly, one or more partly annular thin distortable lips or projections 7 is designed integral with the molded cover, so that the first entry of the screw 1 distorts the lip(s) along the threaded cylindrical surface of the terminal block, to the position diagrammatically shown at 8, whereat it partly occupies space between the screw and terminal block, engaging both and moderately resisting the screw from turning.

The screw can be unscrewed from the fully down position shown, by a finite number of turns, to a shipping position whereat it has been calculated or otherwise predicted, that the conductor could be inserted reasonably freely into hole 6.

The switch can then be shipped, in the knowledge that the screw is in practice captive in the shipping position, by which for instance the free end 9 of the clamping screw shank lies just above the top 10 of the transverse hole 6 which is to accommodate the terminal conductor.

Alternatively, the screw can be screwed directly into the shipping or transporting position by a calculated number of turns or to a predictable amount, without requiring that the first be turned to the fully home position shown in FIG. 1. The invention thus can specifically embody a method of transporting., where the clamping screw is inserted into a clearance hole 3 in the housing lid or cover 2 distorting the lip 7 to the position 8, and threaded directly or indirectly to a transporting position whereat the free end 9 of the clamping screw shank lies just above the top 10 of a transverse hole 6 so as not to impede entry of a terminal conductor.

The invention can also embody a clamping method, where the above shipping or transporting method includes also inserting a terminal conductor at a switch assembly position, e.g. factory, and screwing the screw into a clamping position securing the terminal.

Figure 2:
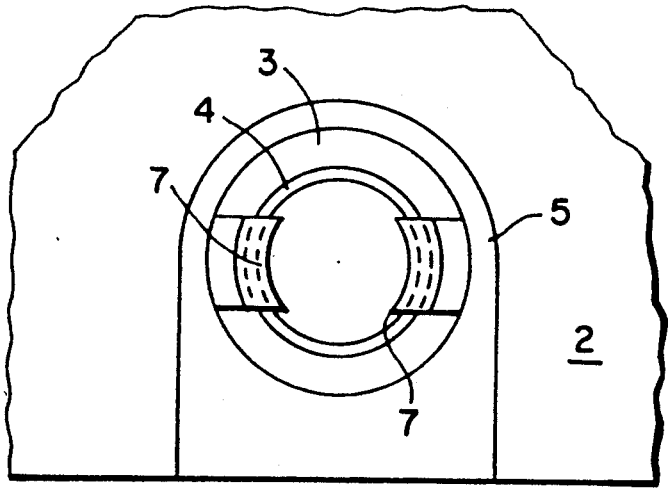
FIG. 2 shows a plan view of a lipped aperture and a threaded hole for a clamping screw not yet inserted.

Referring to FIG. 2, the screw is absent and so the two lips 7 formed on cover 2 as shown in FIG. 1 have not yet been distorted into the region of thread 4. There may be one, two or more lips 7, or it could be continuous, with or without radial cuts etc.

It will be seen from FIG. 1 and FIG. 2 that the clearance hole 3 preferably has an initial large locating region 11, then a tapering portion 12 tapering to the very thin inwardly projecting distortable lip portion 7. The invention covers the switch details as shown in FIG. 2 before introduction of a clamping screw, or as shown in FIG. 1 but with the screw introduced only up to, or withdrawn up to, a pre-clamping position suitable and captive in that position for transportation, or the method of transportation, and/or clamping at the terminating station (e.g. factory) with the steps described above. After screw clamping, the termination may or may not be made permanent by paint, lacquer etc. as desired.

I claim:

1. A terminal assembly for electrical apparatus comprising:

a plastic housing;

a terminal block disposed in said housing;

a threaded hole in said terminal block;

an aperture in said plastic housing overlying said threaded hole;

a projection unitary with said plastic housing extending inward of said aperture from a periphery thereof; and a screw inserted through said aperture and turned part way into said threaded hole;

said projection being deflected into said threaded hole and distorted between cooperating threads of said screw and said hole to provide an interference fit therebetween retaining said screw at whatever depth it is turned into said hole.

2. The terminal assembly as defined in claim 1 wherein said screw is retained by said distorted projection at an intermediate position.

3. The terminal assembly as defined in claim 2 wherein said screw is initially turned fully into said hole and subsequently backed out to said intermediate position.

4. The terminal assembly as defined in claim 3 wherein said terminal block comprises a transverse orifice intersecting said threaded hole, said orifice being accessible from outside said housing for insertion of an elongated conductor therein to be clamped to said terminal.

5. The terminal assembly as defined in claim 4 wherein said intermediate position is attained with a threaded end of said screw located immediately adjacent a peripheral edge of said orifice without extending into said orifice.

6. The terminal assembly as defined in claim 5 wherein said aperture comprises, in axial order from an exterior of said housing, an initial large locating region for said screw to be inserted, a tapering region, and said projection.

7. The terminal assembly as defined in claim 6 wherein a termination completed by clamping an inserted conductor by turning said screw tight thereagainst is made permanent by applying paint or lacquer to said screw at said housing.

* * * * *